United States Patent [19]

Bastida

[11] Patent Number: 4,627,181

[45] Date of Patent: Dec. 9, 1986

[54] FLOW REGULATING VALVE FOR STEAM IRON STEAM CHAMBER

[75] Inventor: Tomas Bastida, Eibar, Spain

[73] Assignee: Ofcina de Investigacion Agrupada, S.A., Eibar, Spain

[21] Appl. No.: 674,575

[22] Filed: Nov. 26, 1984

[51] Int. Cl.[4] ..... D06F 75/18

[52] U.S. Cl. ..... 38/77.7; 219/273; 251/11

[58] Field of Search ..... 38/77.5, 77.7, 77.83; 251/11; 337/361; 219/273

[56] References Cited

U.S. PATENT DOCUMENTS

| | | | |
|---|---|---|---|
| 2,337,077 | 12/1943 | Woodman | 38/77.7 |
| 2,981,017 | 4/1961 | Tesmer et al. | 38/77.7 |
| 3,464,227 | 9/1969 | Matthies | 251/11 X |
| 4,125,953 | 11/1978 | Colombo | 38/77.7 |
| 4,203,026 | 5/1980 | Walter et al. | 38/77.7 X |
| 4,372,486 | 2/1983 | Tomioka et al. | 251/11 X |
| 4,412,650 | 11/1983 | Young et al. | 251/11 X |

FOREIGN PATENT DOCUMENTS 2936812 8/1981 Fed. Rep. of Germany .

*Primary Examiner*—Werner H. Schroeder

*Assistant Examiner*—Andrew M. Falik

*Attorney, Agent, or Firm*—Laff, Whitesel, Conte & Saret

[57] ABSTRACT

A steam iron with a valve for controlling the flow of water from a water reservoir to a steam generating chamber. The valve has a displaceable bridge-shaped member positioned outside the water reservoir and spaced apart from a shaft carrying member. A valve stem extends between the legs through the bridge-shaped member and through a contour cam attached to the top of the bridge-shaped member. The valve stem is attached to the shaft carrying member. The contour cam has a first slanted surface along its circumference upon which a shaft carrying member projection may rest. There are two bimetallic elements sensitive to predetermined temperature changes, located on the steam generating chamber and symmetrically positioned with respect to the valve stem and connected to the legs of the bridge-shaped member, such that when the bimetallic members reach a predetermined temperature, they exert upward pressure against the legs of the bridge-shaped member and raise the bridge-shaped member toward the shaft carrying member thereby permitting a flow of water from the reservoir to the steam generating chamber.

7 Claims, 11 Drawing Figures

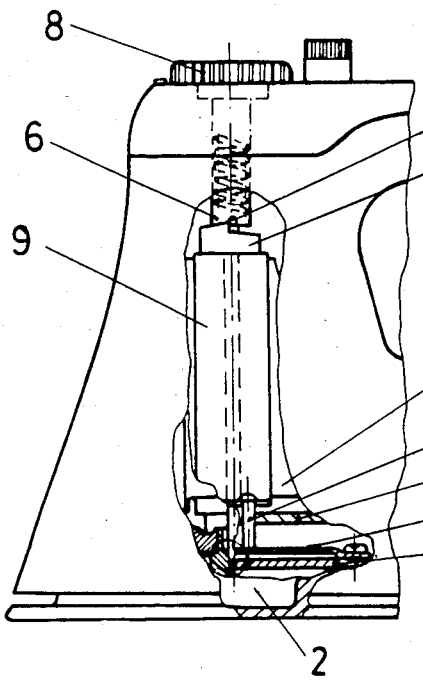
Fig 2
Fig 2A
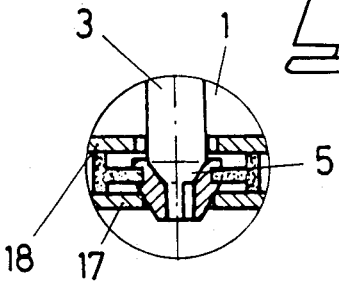
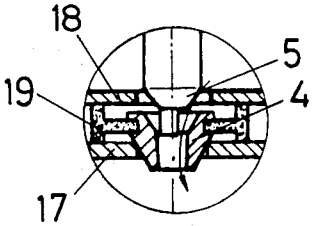
Fig 3A
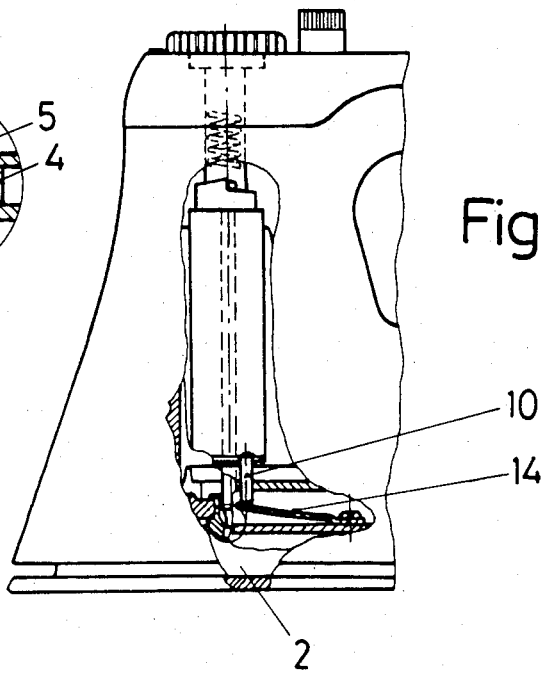
Fig 3

FLOW REGULATING VALVE FOR STEAM IRON STEAM CHAMBER

The present invention relates to a valve for controlling the flow of water from a water reservoir to a steam generating chamber by means of a closing shaft. A bridge shaped member having two legs with the shaft extending through said bridge-shaped member between its legs, a contour cam through which the shaft passes and two bimetallic elements positioned with respect to the shaft and bridge-shaped member so as to control the flow of water from the reservoir to the steam generating chamber when a predetermined temperature is reached.

BACKGROUND OF THE INVENTION

All of the steam irons which generate steam as an aid to the ironing operation generally have: a steam chamber in which the steam is generated. The steam chamber is located in the sole of the iron and is heated by the heating of the iron. A duct supplies water to a spraying or steam chamber, from the storage chamber. It is known to insert, in the passage duct between the storage chamber and the spraying chamber, a valve to open or close the duct at will.

German Patent P No. 2936812 shows a steam iron using a sprinkling or drip valve, which is in contact union with a bimetal affixed on one side to the spraying chamber. The shape and variation movement of the bimetal takes place at a right angle with the axis of the valve body.

SUMMARY OF THE INVENTION

It is an object of the present invention to provide a bimetallic operated valve means to automatically prevent the passage of water to the spraying chamber until there has been reached a temperature sufficient to cause the transformation of the water into steam and wherein the sprinkling or drip valve essentially consists of a closing shaft which when moving vertically on the valve seat opens or closes the passage. With one of its ends, the other end of the closing shaft is affixed to a shaft-carrying member, a lateral projection extending radially from the shaft-carrying member, an operating member in the shape of a bridge, which in its lower part ends with two small vertical pin cylinders and in the upper part of that member there exists an extension the horizontal section of which is in the form of a circular ring and the lateral section of which is slanted, forming (giving origin to) a kind of contour cam through the central opening of which there can run the shaft-carrying member but which does not accept the passage through said opening, of the lateral projection of the shaft-carrying member.

Two bimetallic blades are located on the spraying chamber and on each of which there rests one of the cylinders of the bridge-shaped member.

All of the above results in the fact that the opening of the valve is determined by the operation of the two bimetallic elements as well as by the angular position of the shaft-carrying member respective to the slanted circumference surface of the container cam of the bridge-shaped member. In a front position of the steam iron a water chamber or water reservoir 1 is located above a steam or spraying chamber 2. The two chambers are separated by a passage being opened and closed by the forward end 5 of a closing shaft or valve stem 3.

The end 5 is shaped to conform to a valve seat 4. Attached to the rear end of the valve shaft is a shaft-carrying member 6 having a lateral projection 7. Connected to shaft carrying member is an external control 8 adapted to turn the shaft-carrying member. A bridge-shaped member 9 has two cylindrical legs 10 and 11 extending from one end through a lower well 18 of the water chamber. A contour cam 12 attached to the other end of the bridge member. Bimetallic blades 14 and 15 are attached at one end to the cylindrical legs to raise and lower the bridge member.

According to our invention, water passes from chamber 1 to the spraying or steam chamber 2 through a valve port having a valve seat 4. The movable closing shaft or valve stem 3 has its forward end 5 shaped to close or open the valve port by moving the shaft in the vertical direction.

The closing shaft has affixed to its other end a shaft-carrying member 6 which is cylindrical and hollow. The shaft-carrying member has a projection 7 projecting in a predetermined manner in the radial direction from its lower end. Any longitudinal or rotating motion performed by the shaft-carrying member 6 also causes a corresponding motion by the closing shaft 3.

An external command or control means 8 is coupled to the top of the shaft-carrying member 6 and fits telescopically over it as may be seen in FIGS. 4, 5, 6 and 7. The control means coupling is rigid:

Other features of the present invention will appear from the detailed description of the preferred embodiment which will now be explained in conjunction with the accompanying drawings.

BRIEF DESCRIPTION OF THE DRAWINGS

FIG. 2 is a partial side view of the steam iron represented in FIG. 1, with cut-away portion and the valve closed.

FIG. 2*a* is an enlarged side view of the valve steam end of FIG. 2;

FIG. 3 is partial side view of the steam iron of FIG. 1 with cut-away portions showing an open valve;

FIG. 3*a* is an enlarged side view of the valve steam end with an open water passage of FIG. 3;

DESCRIPTION OF THE PREFERRED EMBODIMENT

Figure 1:
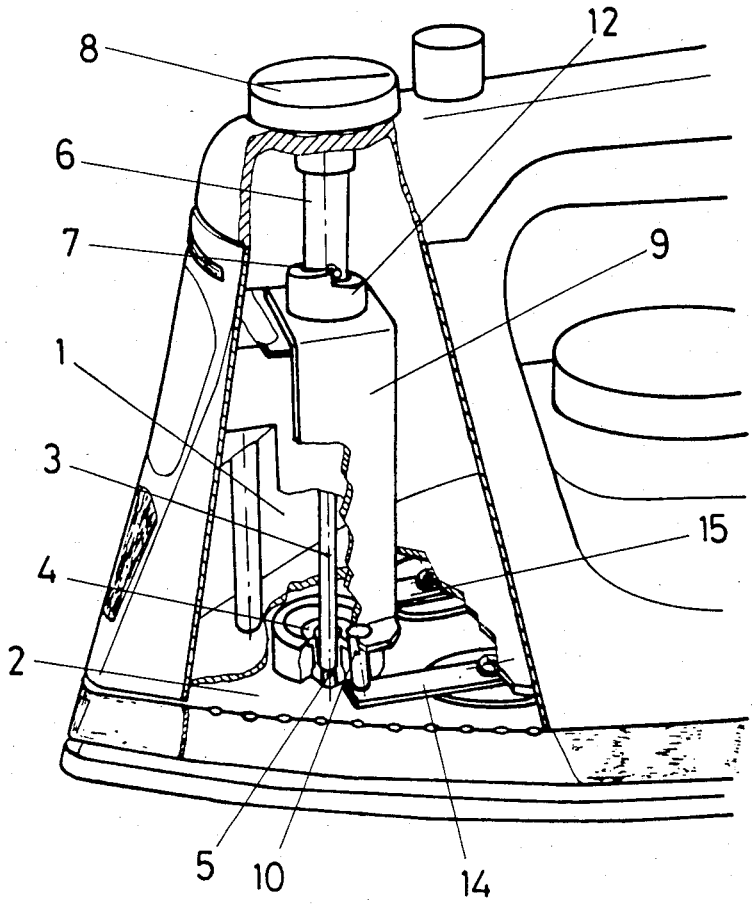
FIG. 1 is a partial perspective view of a steam iron with cut-away portions showing the valve means of the present invention.

Referring to FIG. 1 there is shown a steam iron in the rotating direction but movable in the axial direction. A spring 16 is located between the telescopic fitting of these members. The spring ensures that the forward end 5 of the closing shaft 3 rests against the valve seat 4 closing the water passage, or that projection 7 of the shaft-carrying member 6 rests on the slanted circumference surface 13 of the contour cam 12. The valve in that latter case being more or less open. The opening of the passage port is checked through the intervention of the bridge-shaped member 9 which in its lower part has two legs each one of them ending with a cylindrical pin, 10 & 11 which respectively rest on the bimetallic blades 14 and 15 located on the lid 17 of the spraying or steam making chamber 2.

Figure 9:
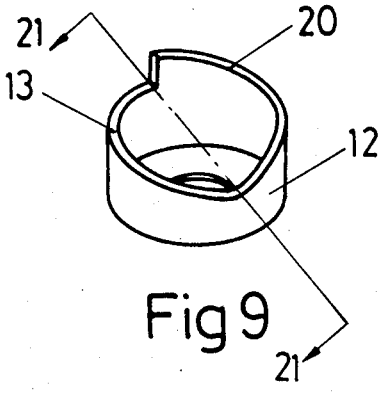
FIG. 9 is a perspective view of the contour cam shown in FIG. 8.

The bridge-shaped member has on its upper end contour cam 12. In this embodiment the contour cam is an extension of the bridge member and is a circular ring and formed by a laterally slanted open end. The base of the cam as shown in FIG. 9 has a central opening that is larger than the diameter of the bridge to permit the free passage of the shaft-carrying member 6, but not the passage of the lateral projection 7 which remains located vertically above the slanted circumference surface 13 of the contour cam 12.

Figure 4:
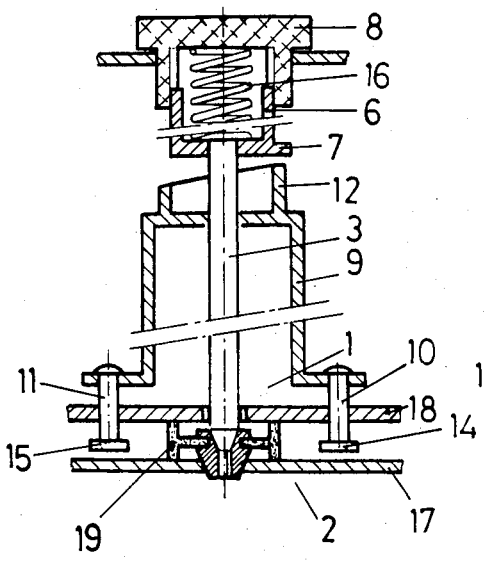
FIG. 4 is an enlarged side view of the valve of FIG. 2 in its steam working position.
Figure 5:
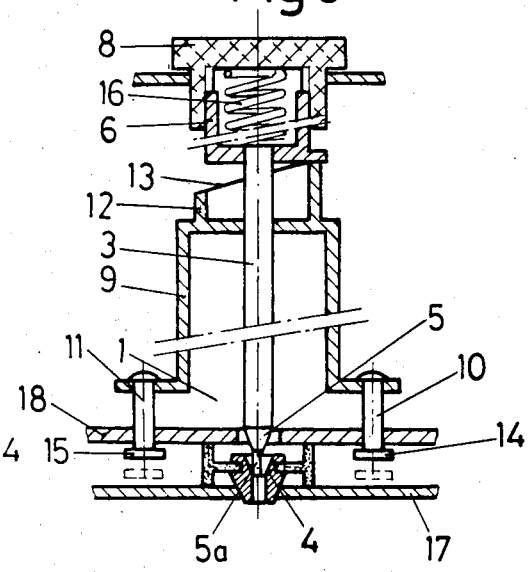
FIG. 5 is an enlarged side view of the valve of FIG. 3 in its steam working position.

If we place the external command or control 9 in the extreme position of "steam production" it will correspond to a rotating position of the shaft-carrying member 6 such as represented in FIGS. 2, 3, 4 and 5, with the lateral projection 7 located on or over the high point of slanted surface 13 of the cam 12 so that the valve will remain closed while the iron is cold, and the bimetallic members 14 and 15 are in their lowest position (FIGS. 2 and 4). When the bimetallic members 14 and 15 heat up, they will push on the respective cylinders 10 and 11 and they will raise the bridge-shaped member 9 which with cam 12 will displace the lateral projection 7 of the shaft-carrying member 6 only when the temperature is suitable for the spraying (formation of steam) (if the temperature is not reached, the cam 12 will not succeed in displacing the lateral projection 7 and, therefore, the water passage would not open). Moving the bridge shaped member compresses the spring 16 and vertically moves the valve stem 3 to separate the forward end 5 from the seat 4 to open the water passage and produve steam-FIGS. 3 and 5.

The use of the bimetallic elements 14 and 15 in diametral arrangement together with the configuration of the bridge-shaped member 9, ensures a balanced and powerful force sufficient to overcome the resistance of the members.

Figure 6:
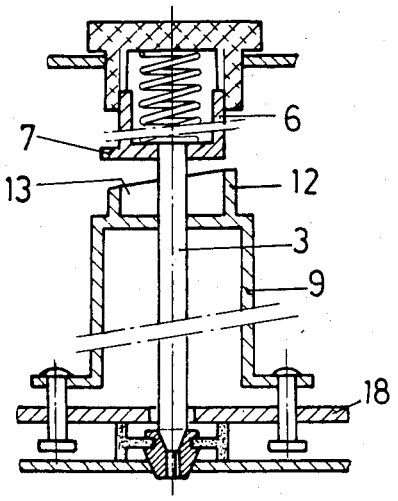
FIG. 6 and 7 are enlarged side views of the valve of FIG. 1 when the iron is for dry ironing.
Figure 7:
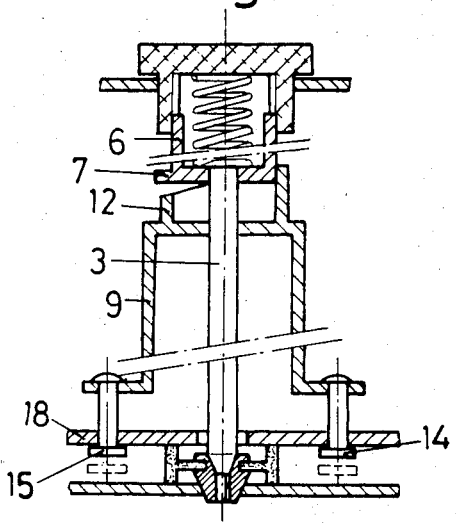

When we place the external command or control 8 in its other extreme position (closed or dry ironing), as represented in FIGS. 6 and 7, the shaft-carrying member. 6 is rotated and the lateral projection 7 remains located on or over the lower point of the slanted surface 13 of the cam 12. In this case, the valve will remain closed not only when the iron is cold (FIG. 6) but also when it is hot (FIG. 7). In this position, when the bimetallic elements 14 and 15 become hot, they push and raise the bridge-shaped member 9 but the displacement is not sufficient for the cam 12 to come in contact with the lateral projection 7 to push or move the shaft-carrying member 6. Consequently the closing shaft 3 and forward forward end 5 will continue to close the valve seat.

The above position proves especially useful as it makes it possible to interrupt the formation of steam, for "dry ironing" for example, which can be done at will.

Obviously, in addition to those two described extreme positions, with the outside control or command 8 it is possible to adjust a whole series of intermediate positions in which the lateral projection 7 remains at definite distances from surface 13 of cam 12 and which will correspond to definite levels of steam production for a given degree of deformation of the bimetallic elements 14 and 15 and finally for a given temperature, and that permits the generation of a quantity of steam not exclusively dependent on temperature since, according to the type of material of the garment to be ironed it is possible to regulate the desired flow of steam.

FIG. 9 illustrates in detail the preferred contour of cam 12. The cam has two slanted surfaces 13 and 20. Slanted surface 13 is used for the work positions which have been described in FIGS. 4 and 7; while the other slanted surface 20 is used solely for the "self-cleaning" position, which has been described in FIG. 8. In FIGS. 4 to 7, the contour cam 12 which is seen in them corresponds to the section given by a vertical plane along line (21—21) in FIG. 9.

Figure 8:
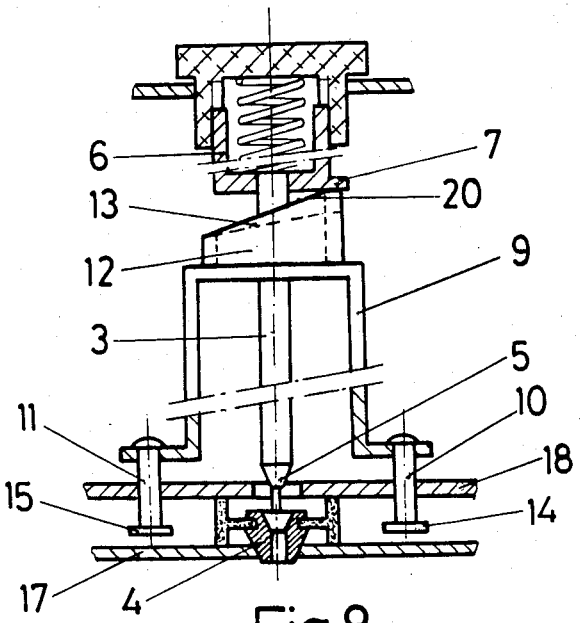
FIG. 8 is an enlarged side view of the valve of FIG. 1 when the iron is in its self-cleaning position.

In a preferred embodiment, we have an external command or control 8 with a "self-cleaning" position, as represented in FIG. 8 and the bridge-member 9 has the contour cam of FIG. 9. In FIG. 8, the shaft-carrying member 6 is rotated and the lateral projection 7 rest on surface 20 of the contour cam 12. The surface 20 is sufficiently high such that the valve shall always remain completely open, whatever the temperature of the iron since even in the cold position of the bimetallic elements 14 and 15, and the position of the bridge-shaped member 9, the relative position of the closing shaft 3 with respect to valve end 5 is such as noted in FIG. 8 with the shaft-carrying member being maintained in an upward position by the cam surface 20 even though the bridge 9 is in its lowered position and thus will never close the water passage.

To provide for a more fine passage of the water, the valve 5 has extending therefrom a rabbet or chamfer **5*a* of lesser section as may be seen in the enlarged details in FIGS. 2 and 3**.

Referring to FIGS. 2 and 3, the valve seat 4 is preferably metallic, in order to obtain a good seat surface and is mounted on an elastic disc 19 of a synthetic material which with its upper and lower circular projection fits in a movable manner against the surface of lid 17 of the spraying or steam formation chamber 2 and of the upper partition 18.

The nature of the present invention as well as its industrial mode of execution having been sufficiently described and those skilled in the art will readily perceive changes in forms, in material and in arrangement, without for as much leaving the scope of the present invention. Therefore, the appended claims are to be construed to cover all equivalent structures which fall within the true scope and spirit of the invention.

I claim:

1. A valve for controlling the flow of water from a water reservoir to a steam generating chamber, comprising:

a closing shaft having a lower end for seating in a hole in said steam generating chamber;

a shaft carrying member affixed to the upper end of said closing shaft.

a projection extending radially from said shaft carrying member;

an external control affixed to said shaft carrying member for rotating said shaft carrying member and projection;

a displaceable bridge-shaped member positioned outside said water reservoir and spaced apart from said shaft carrying member, said bridge-shaped member having two legs, and said shaft extending through said bridge-shaped member and between said legs;

a contour cam adjacent said bridge-shaped member and through which said shaft and shaft carrying member pass, said contour cam having a first slanted surface along its circumference upon which said projection may rest;

a spring fixed to said external control and said shaft for urging said shaft into said hole; and two bimetallic elements sensitive to predetermined temperature changes, each of said elements being located on said steam generating chamber, symmetrically positioned with respect to said closing shaft, and below a leg of said bridge-shaped member such that when the bimetallic members reach a predetermined temperature, they exert upward pressure against the legs of said bridge-shaped member and raise said bridge-shaped member toward said shaft carrying member thereby permitting a flow of water from said reservoir to said steam generating chamber.

2. A valve as recited in claim 1 wherein said bimetallic elements are spaced apart from said legs so that when said projection is located on the highest part of said first slanted surface of said contour cam, the bimetallic elements will exert upward pressure against the legs of said bridge-shaped member upon reaching a predetermined temperature to cause said bridge-shaped member to displace said shaft carrying member and shaft sufficiently to fully open the hole.

3. A valve as recited in claim 1 wherein said bimetallic elements are spaced apart from said legs so that when said projection is located on the lowest part of said first slanted surface of said contour cam, the bridge-shaped member will not be raised sufficiently to displace said shaft carrying member and shaft or open said hole regardless of the temperature of the bimetallic elements.

4. A valve as recited in claim 1 wherein said bimetallic elements are spaced apart from said legs so that when said projection is located between the lowest and highest parts of said first slanted surface of said contour cam, the bimetallic elements will exert upward pressure against the legs of said bridge-shaped member to cause said bridge-shaped member to displace said shaft carrying member and shaft sufficiently to partially open the hole.

5. A valve as recited in claim 1 wherein said contour cam has a second slanted surface along its circumference above said first slanted surface, so that when said projection is located on the highest part of said second slanted surface, said shaft carrying member and shaft are sufficiently displaced to open the hole fully regardless of the temperature of said bimetallic elements.

6. A valve as recited in claims 1, 2, 3, 4 or 5, further comprising said legs of said bridge-shaped member each terminate in a pin extending toward said bimetallic elements and for making contact with said elements.

7. A valve as recited in claim 1, 2, 3, 4 or 5, further comprising said lower end of said closing shaft and said hole are chamfered to mate with each other, so that variable amounts of water flow from said reservoir to said steam generating chamber occur depending on the position of said closing shaft within said hole.

* * * * *